US008814041B2

(12) United States Patent
Cha et al.

(10) Patent No.: US 8,814,041 B2
(45) **Date of Patent: *Aug. 26, 2014**

(54) AUTOMATIC FINANCIAL AUTOMATION EQUIPMENT AND CONTROL METHOD THEREOF

(75) Inventors: Jin Hwan Cha, Seoul (KR); Won Joon Lee, Seoul (KR); Dong-Sik Lee, Seoul (KR)

(73) Assignee: Nautilus Hyosung Inc., Seoul (KR)

( * ) Notice: Subject to any disclaimer, the term of this patent is extended or adjusted under 35 U.S.C. 154(b) by 157 days.

This patent is subject to a terminal disclaimer.

(21) Appl. No.: 13/519,524

(22) PCT Filed: Dec. 31, 2010

(86) PCT No.: PCT/KR2010/009609

§ 371 (c)(1),
(2), (4) Date: Jun. 27, 2012

(87) PCT Pub. No.: WO2011/081494

PCT Pub. Date: Jul. 7, 2011

(65) Prior Publication Data

US 2012/0279982 A1 Nov. 8, 2012

(30) Foreign Application Priority Data

Dec. 31, 2009 (KR) ..... 10-2009-0136164

(51) Int. Cl.
*G07F 19/00* (2006.01)

(52) U.S. Cl.
USPC ..... 235/379; 235/383

(58) Field of Classification Search
USPC ..... 235/379, 380, 383; 194/206, 207; 902/8, 9, 11, 12, 13, 14, 15
See application file for complete search history.

(56) References Cited

U.S. PATENT DOCUMENTS

| | | | | | |
|---|---|---|---|---|---|
| 4,146,220 | A | * | 3/1979 | Barton | 271/233 |
| 4,542,287 | A | * | 9/1985 | Watanabe | 235/379 |
| 4,726,474 | A | * | 2/1988 | Arikawa et al. | 209/534 |
| 5,240,368 | A | * | 8/1993 | Graef et al. | 414/788.9 |
| 5,975,273 | A | | 11/1999 | Zwahlen et al. | |
| 8,181,764 | B2 | * | 5/2012 | Cha et al. | 194/206 |
| 2009/0160127 | A1 | | 6/2009 | Kong et al. | |

FOREIGN PATENT DOCUMENTS

| | | | |
|---|---|---|---|
| EP | 0 471 300 | A2 | 2/1992 |
| EP | 0 793 197 | A2 | 9/1997 |
| EP | 1 736 937 | A1 | 12/2006 |
| KR | 20-0392317 | Y1 | 8/2005 |
| KR | 10-2007-0052048 | A | 5/2007 |
| KR | 10-2009-0072666 | A | 7/2009 |

OTHER PUBLICATIONS

PCT International Search Report and Written Opinion, PCT/KR2010/009609, Sep. 27, 2011, 11 Pages.
European Patent Office, Supplementary European Search Report and Opinion, European Patent Application No. 10841326.1, Jun. 13, 2013, five pages.

* cited by examiner

*Primary Examiner* — Daniel St Cyr
(74) *Attorney, Agent, or Firm* — Fenwick & West LLP

(57) ABSTRACT

An automatic teller machine (ATM) and a control method for the same are provided. According to the ATM and the control method, stacking of paper mediums being transferred to a stacking space of a carriage may be guided by a medium guide provided to the carriage. Position of the medium guide may be adjusted by a guide adjustment device corresponding to various types of the paper mediums.

13 Claims, 9 Drawing Sheets

AUTOMATIC FINANCIAL AUTOMATION EQUIPMENT AND CONTROL METHOD THEREOF

TECHNICAL FIELD

The present invention relates to an automatic teller machine (ATM) and a control method for the same, and more particularly, to an ATM capable of efficiently stacking paper mediums being transferred into a carriage and stably stacking various types of paper medium, and a control method thereof.

BACKGROUND ART

Generally, an automatic teller machine (ATM) refers to an automated apparatus providing fundamental monetary services, such as payment and withdrawal of cash and check, using a card or a bankbook regardless of time and places without a bank teller. Recently, use of the ATM is not limited to banking facilities such as banks but expanded to convenience stores, department stores, and other public places.

The ATM may be classified into a cash dispenser, a cash receiver, and a cash dispenser and receiver. In these days, the ATM is used for not only payment and withdrawal of cash but also payment and withdrawal of check, bankbook arrangement, fee payment by giro, ticketing, and the like.

Inside the ATM, a medium transfer path is formed for transfer of a paper medium such as cash, checks, tickets, merchandise coupons, and the like. Generally, the medium transfer path includes combination of rollers and belts. The medium transfer path is very complicated in structure and control. Also, the entire size of the medium transfer path is large. Therefore, increase in the transfer path for the paper mediums is limited. In addition, a paper jam frequently occurs in a transfer unit. Also, operations for dispensing and receiving of paper mediums are very complicated to control.

DISCLOSURE OF INVENTION

Technical Goals

An aspect of the present invention provides an automatic teller machine (ATM) capable of dispensing paper mediums quickly and conveniently by directly transferring a carriage on which the paper mediums are temporarily stacked to a dispenser portion, and a control method for the same.

Another aspect of the present invention provides an ATM capable of easily changing an advancing direction of the carriage by rotating a rotor in which the carriage is inserted, and conveniently transferring the carriage to any one of a plurality of dispenser portions, and a control method for the same.

Another aspect of the present invention provides an ATM capable of stably and smoothly stacking, in the carriage, various types of paper mediums transferred into the carriage.

Technical Solutions

According to an aspect of the present invention, there is provided an automatic teller machine (ATM) including a case in which a dispenser portion is disposed in different positions, a medium transfer unit provided in the case to transfer paper mediums to be dispensed through the dispenser portion, a carriage including a stacking space to temporarily stack the paper mediums, being configured to be moved to the dispenser portion along a movement path formed in the case, a rotor in which the carriage is withdrawably inserted, being configured to be rotated along with the carriage between a first position in which the paper mediums are stacked in the carriage and a second position in which the carriage is moved to the movement path, a medium guide movably provided to the carriage to adjust size of the stacking space according to size of the paper mediums being transferred to the stacking space, and a guide adjustment device provided to the rotor and configured to be connected to the medium guide when the carriage is received in the rotor to adjust a position of the medium guide.

That is, the paper mediums may be transferred to the stacking space of the carriage by the medium transfer unit. In addition, the paper mediums may be stably stacked in a proper position in the stacking space by the medium guide. Since position of the medium guide may be adjusted by the guide adjustment device according to size of the paper mediums, various sizes of the paper mediums transferred by the medium transfer unit may be smoothly stacked in the stacking space.

At least one of the rotor and the carriage may include a first carriage sensor to detect whether a paper medium is present in the carriage, a second carriage sensor to detect whether the carriage is disposed in a right position in the rotor, and a third carriage sensor to detect whether the medium guide is disposed in a right position in the carriage.

The medium guide may include a movable plate disposed at a lower part of the carriage to be movable in a width direction of the paper mediums, a medium guiding projection protruding from the movable plate to guide a stacking position of the paper mediums being transferred to the stacking space, and an elastic member connected to the carriage and the movable plate to provide an elastic force to the movable plate in any one direction between a first direction increasing the stacking space and a second direction decreasing the stacking space. That is, the size of the stacking space may be adjusted by positions of the medium guiding projections.

The medium guiding projection may include a damping portion disposed on a front side to absorb a collision impact with the paper mediums being transferred to the stacking space. Accordingly, although the paper mediums transferred by the medium transfer unit collides with the medium guiding projections, the paper mediums may be prevented from bouncing out or being folded or creased.

The carriage may include a first carriage portion rotated along with the rotor when the rotor rotates, a second carriage portion disposed to face the first carriage portion so that the stacking space is formed between the first carriage portion and the second carriage portion, and a carriage driving portion connected to the first carriage portion and the second carriage portion so that the first carriage portion and the second carriage portion are folded to each other and moved along the movement path, and the movable plate is provided to the first carriage portion while the medium guiding projections are disposed to pass through a slit hole formed at the second carriage portion.

The medium adjustment device may include a stopper connected to a locking portion formed at the medium guide when the carriage is disposed in the rotor, being provided to the rotor to linearly move to move the medium guide in another direction between a first direction increasing the stacking space and a second direction decreasing the stacking space, a stopper driving portion provided at the rotor to supply a driving force to the stopper, and a power transmission member disposed between the stopper driving portion and the stopper to transmit the driving force of the stopper driving portion. Therefore, the driving force of the stopper driving portion may be transmitted to the stopper through the power transmission member. By a moving force of the stopper, the movable plate may be moved in the second direction.

The power transmission member may include a power transmission shaft rotatably provided to the rotor, a gear portion provided to an end of the power transmission shaft to transmit the driving force of the stopper driving portion, and a link portion connected to the other end of the power transmission shaft and the stopper to receive a rotational force of the power transmission shaft and convert the rotational force to a linear motion force of the stopper.

The gear portion may include a driving gear connected to the stopper driving portion, a driven gear connected to the end of the power transmission shaft, and at least one relay gear rotatably provided to the rotor and disposed between the driving gear and the driven gear to be operated in association with the driving gear and the driven gear. That is, when at least one relay gear is properly combined with the driving gear and the driven gear, a magnitude and a direction of the driving force transmitted to the power transmission shaft may be converted conveniently.

The gear portion may include a position setting rib provided around the gear portion in an arc shape. At least one of the rotor and the carriage may include a carriage sensor to detect whether the medium guide is disposed in a right position in the carriage, and the carriage sensor detects the position setting rib to detect whether the medium guide is in the right position. Therefore, whether the medium guide is disposed in the right position may be correctly detected using the position setting rib and the carriage sensor. Accordingly, the right position of the medium guide may be variably set by changing a shape of the position setting rib and a position of the carriage sensor. Here, the carriage sensor may be the same as the third carriage sensor.

The rotor may include rotating portions disposed at opposite side surfaces of the case to be rotatable to movably support opposite sides of the carriage, and a connecting portion connected to the rotating portions disposed at the opposite side surfaces of the case with opposite sides and configured to receive the carriage. The stopper, the power transmission shaft, and the link portion may be connected to the connecting portion whereas the stopper driving portion, the gear portion, and the carriage sensor are provided at an outer side surface of the rotating portion.

According to an aspect of the present invention, there is provided a control method for an ATM, the control method including carriage positioning to detect whether the carriage is disposed in the right position in the rotor and drive the carriage so that the carriage is disposed in the right position in the rotor when the carriage is detected to be not in the right position, remaining medium removing to detect presence of a remaining paper medium in the stacking space of the carriage and remove the remaining paper medium when the remaining paper medium in the stacking space is detected, guide positioning to detect whether the medium guide is disposed in the right position of the carriage and to move the medium guide to the right position of the carriage by the guide adjustment device when the medium guide is detected to be not in the right position, stacking space adjusting to adjust the size of the stacking space by moving the medium guide by the guide adjustment device according to a width of the paper mediums to be stacked in the stacking space, and medium stacking to stack the paper mediums by the medium transfer unit in the stacking space which is size-adjusted by the guide adjustment device.

That is, when the carriage is disposed in the right position and the paper mediums do not remain in the carriage, the medium guide may be set to the right position and the position of the medium guide may be adjusted according to width of the paper mediums positioned in the stacking space. Thus, when the medium guide is disposed in the right position before adjusting the position of the medium guide, operational stability and reliability of the medium guide may be increased. In addition, the operation of the medium guide may be controlled more accurately.

At least one of the rotor and the carriage may include a third carriage sensor to detect whether the medium guide is disposed in a right position in the carriage.

The guide positioning may include determining whether the medium guide is detected by the third carriage sensor, positioning the medium guide in a spot detected by the third carriage sensor when the medium guide is not detected, by moving the medium guide by the guide adjustment device in any one direction between the first direction increasing the stacking space and the second direction decreasing the stacking space, and positioning the medium guide in a spot not detected by the third carriage sensor when the medium guide is detected, by moving the medium guide by the guide adjustment device in any one direction between the first direction increasing the stacking space and the second direction decreasing the stacking space. That is, the right position of the medium guide may be set to a boundary between positions in which the medium guide is detected or not detected by the third carriage sensor.

The stacking space adjusting may include adjusting the stacking space when the paper mediums to be stacked in the stacking space have various width in the first direction increasing the stacking space. The medium stacking may include stacking the paper mediums in the stacking space by the medium transfer unit in order from smallest width to largest width.

Effects of the Invention

According to an automatic teller machine (ATM) and a control method for the same in accordance with an embodiment of the present invention, since paper mediums are directly transferred to a dispenser portion in a bundle, a structure for transferring the paper mediums may be simplified. In addition, a jam of the paper mediums during transfer of the paper mediums may be reduced, thereby preventing reduction in efficiency of the ATM.

According to an embodiment of the present invention, the ATM is structured in such a manner that a carriage in which paper mediums are stacked is directly transferred to a plurality of dispenser portions along movement paths of a case. Therefore, control of a dispensing operation of the ATM may be simplified, and a dispensing time for the paper mediums may be reduced. That is, the dispensing operation for the paper mediums may be quickly performed.

According to the ATM and the control method for the same in accordance with the embodiment of the present invention, the paper mediums transferred into the carriage by a medium guide may be stably stacked. In addition, a position of the medium guide may be varied by a guide adjustment device according to size of the paper mediums. Accordingly, various types of paper mediums may be stacked efficiently.

Also, according to the ATM and the control method for the same in accordance with the embodiment of the present invention, the medium guide is disposed in a right position before the paper mediums are stacked in a stacking space of the carriage, so that the operation of the medium guide is efficiently controlled. Furthermore, before the medium guide is disposed in the right position, the carriage is disposed in a right position and paper mediums remaining in the carriage are removed. Therefore, an operational error that may occur during setting of the right position of the medium guide may be minimized.

BEST MODE FOR CARRYING OUT THE INVENTION

Hereinafter, structure and application of embodiments of the present invention will be described in detail with reference to the accompanying drawings. The following description illustrates one of various aspects of the present invention and constitutes part of a detailed description about the present invention.

However, in explaining the embodiments of the present invention, generally known functions and structures will not be explained in detail for conciseness.

Figure 1:
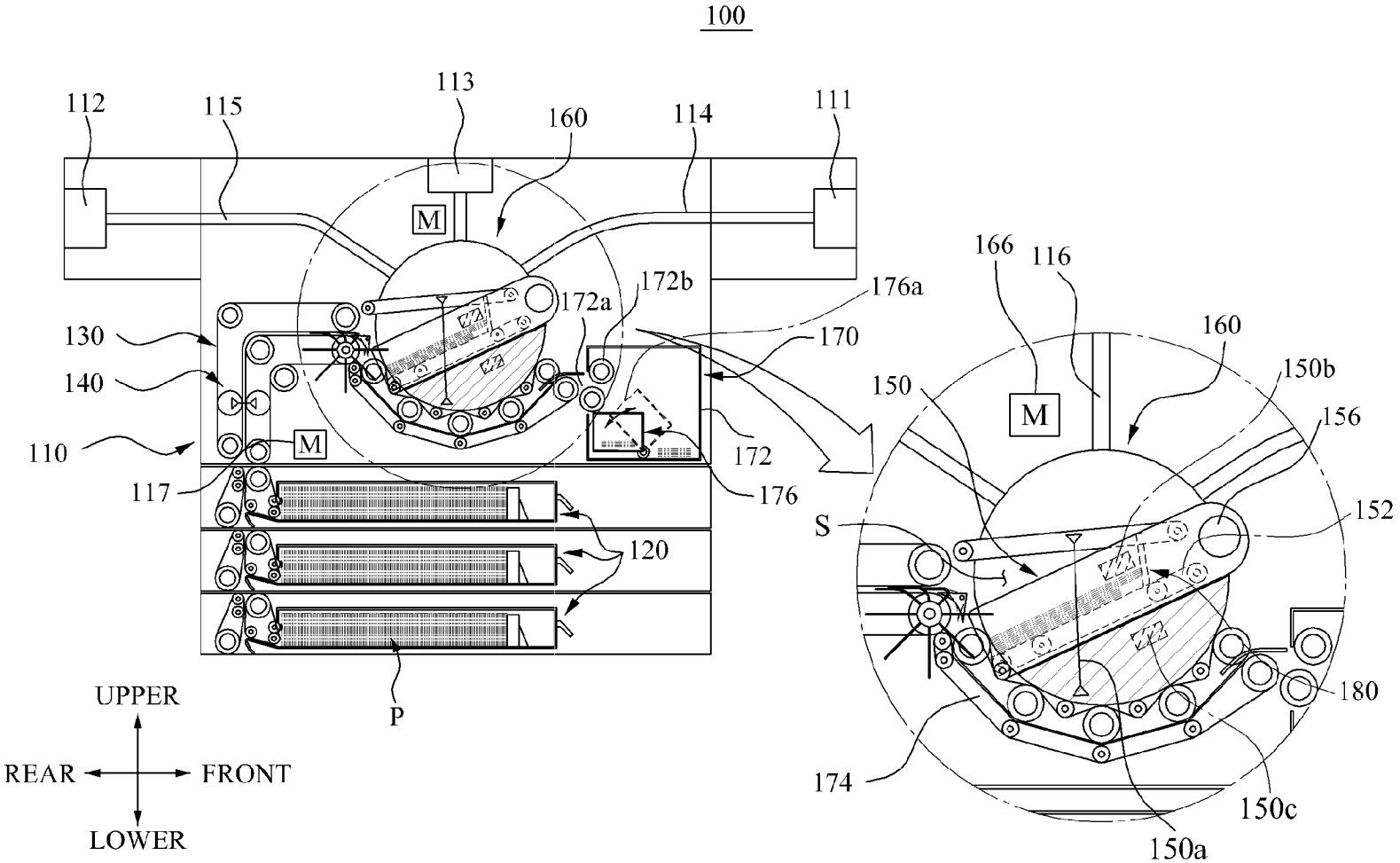
FIG. 1 is a view schematically illustrating a structure of an automatic teller machine (ATM) according to an embodiment of the present invention.
Figure 2:
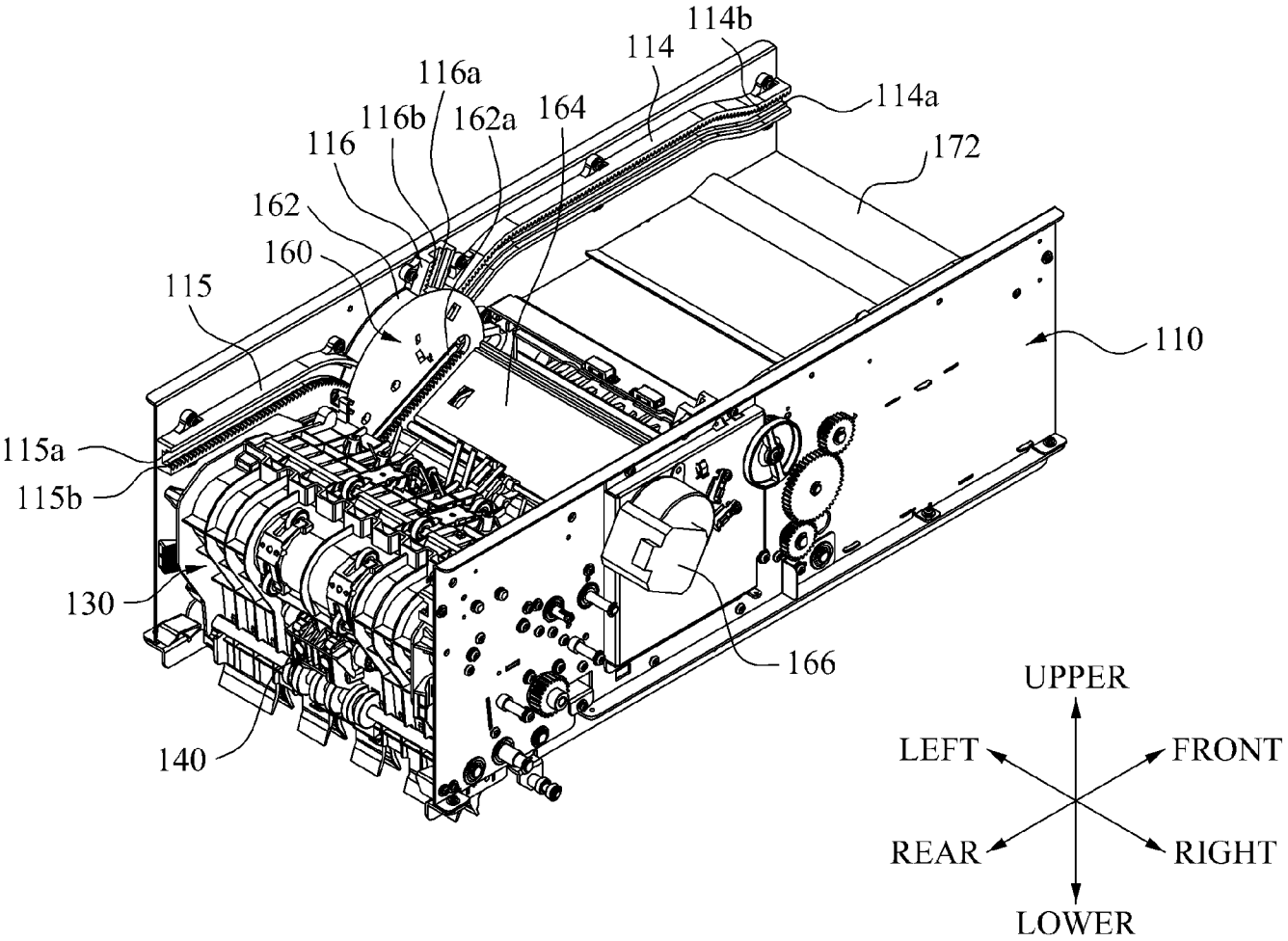
FIG. 2 is a perspective view illustrating main parts of the ATM of FIG. 1.
Figure 3:
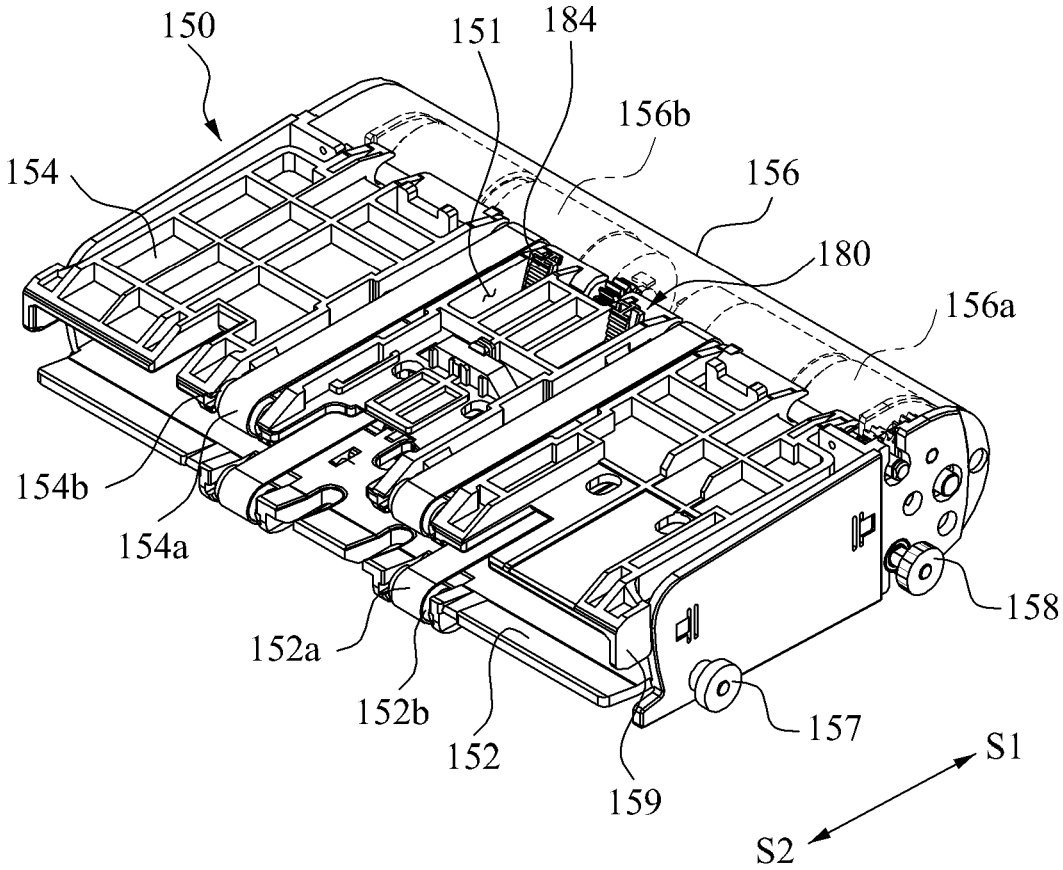
FIGS. 3 and 4 are perspective views illustrating a carriage shown in FIG. 1.
Figure 4:
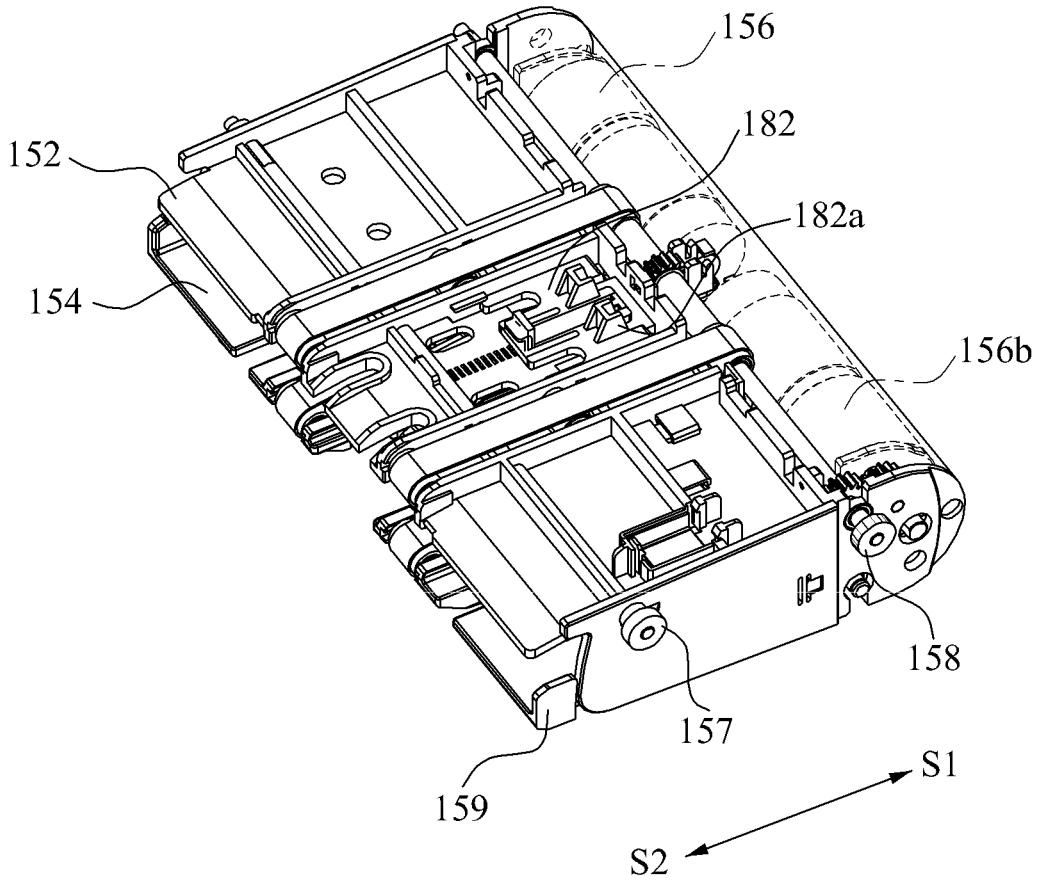
Figure 5:
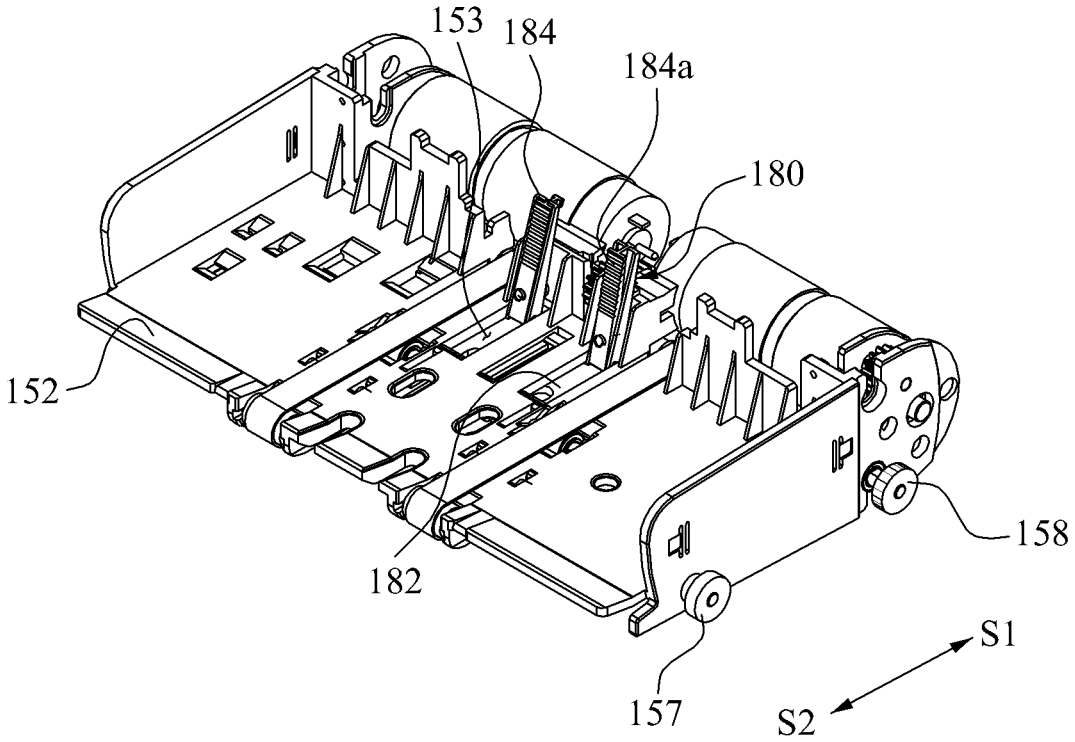
FIG. 5 is a perspective view illustrating part of the carriage shown in FIG. 3.
Figure 6:
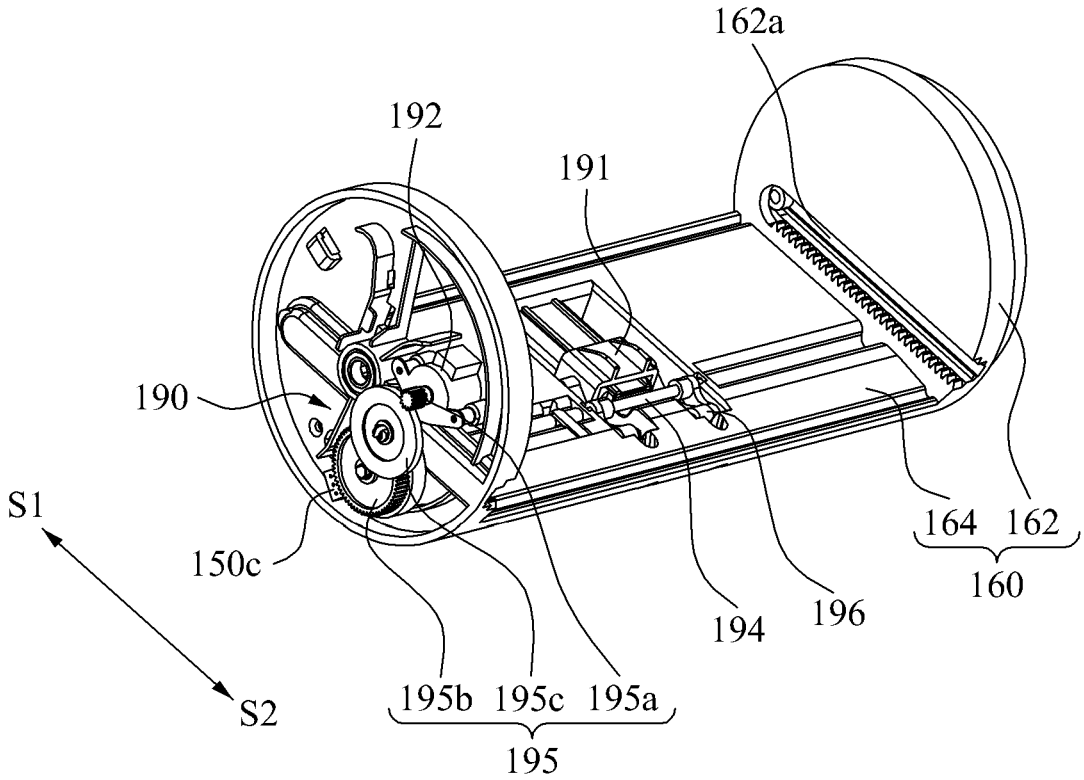
FIG. 6 is a perspective view of a rotor shown in FIG. 2.
Figure 7:
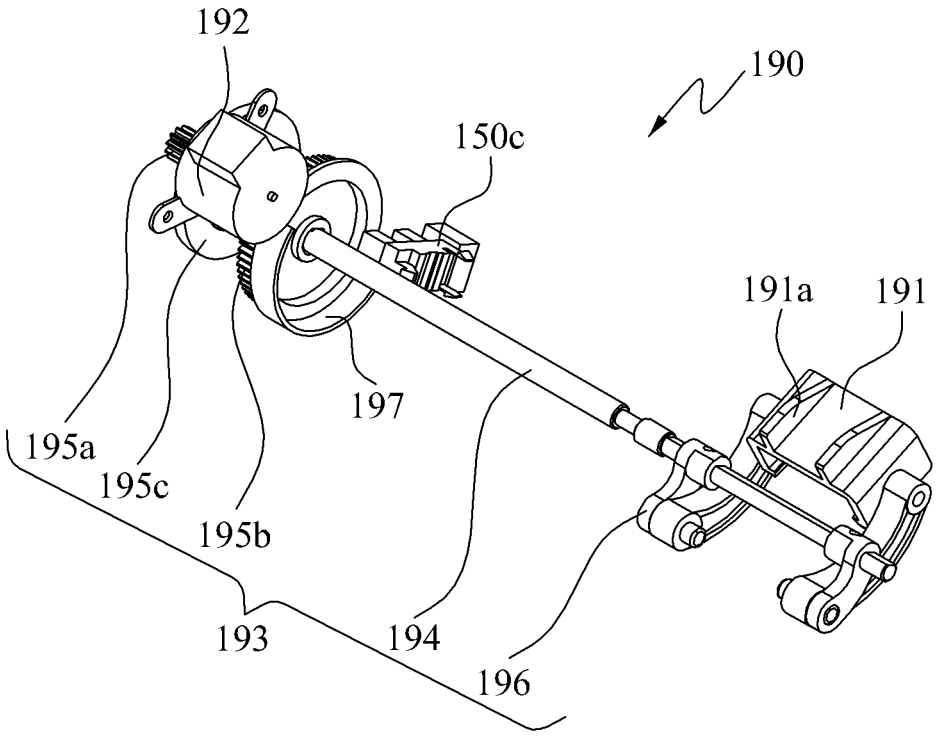
FIG. 7 is a perspective view of a guide adjustment device for the rotor shown in FIG. 6.

FIG. 1 is a view schematically illustrating a structure of an automatic teller machine (ATM) according to an embodiment of the present invention. FIG. 2 is a perspective view illustrating main parts of the ATM of FIG. 1. FIGS. 3 and 4 are perspective views illustrating a carriage shown in FIG. 1. FIG. 5 is a perspective view illustrating part of the carriage shown in FIG. 3. FIG. 6 is a perspective view of a rotor shown in FIG. 2. FIG. 7 is a perspective view of a guide adjustment device for the rotor shown in FIG. 6.

Referring to FIG. 1, the ATM 100 according to the embodiment of the present invention includes a case 110, a medium storage unit 120, a medium transfer unit 130, a medium inspection unit 140, a carriage 150, a rotor 160, and a medium collection unit 170. In the following description, the ATM 100 will be limitedly described as a cash dispenser. However, technical aspects of the present invention are applicable to a cash receiver and a combined cash receiver and dispenser.

The medium storage unit 120 may be disposed at a lower part of the case 110. The medium transfer unit 130, the medium inspection unit 140, the carriage 150, the rotor 160, the medium collection unit 170, dispenser portions 111, 112, and 113, and movement paths 114, 115, and 116 may be disposed at an upper part of the case 110.

Here, the dispenser portions 111, 112, and 113 may be disposed in respectively different positions at the upper part of the case 110. That is, the dispenser portions 111, 112, and 113 may include a front dispenser 111 disposed at a front part of the case 110, a rear dispenser 112 disposed at a rear part of the case 110, and an upper dispenser 113 disposed at an upper surface of the case 110.

The movement paths 114, 115, and 116 may include a front movement path 114 disposed between the front dispenser 111 and the rotor 160, a rear movement path 115 disposed between the rear dispenser 112 and the rotor 160, and an upper movement path 116 disposed between the upper dispenser 113 and the rotor 160. However, the numbers and the positions of the dispenser portions 111, 112, and 113 and the movement paths 114, 115, and 116 are not specifically limited but may be varied according to the design and conditions of the ATM 100.

Referring to FIG. 2, the movement paths 114, 115, and 116 may respectively include guide rails 114*a*, 115*a*, and 116*a* disposed on opposite lateral sides of the case 110 to guide a movement direction of the carriage 150, and rail gears 114*b*, 115*b*, and 116*b* arranged in a length direction of the guide rails 114*a*, 115*a*, and 116*a*, respectively. A guide roller 157 of the carriage 150 may be movably inserted in the guide rails 114*a*, 115*a*, and 116*a*, which will be described later. The rail gears 114*b*, 115*b*, and 116*b* may be in the form of rack gears formed along the guide rails 114*a*, 115*a*, and 116*a*, and may be connected to a moving gear 158 of the carriage 150. The moving gear 158 will be described later.

Referring to FIG. 1, the medium storage unit 120 is adapted to store paper mediums P. Typically, the paper mediums P may include banknotes, checks, merchandise coupons, tickets, and the like. Hereinafter, the paper mediums P will be described as banknotes for convenience of explanation.

The medium storage unit 120 may be integrally formed with a lower part of the case 110. However, in the present embodiment, the medium storage unit 120 will be described to be removably mounted at the lower part of the case 110. For example, the medium storage unit 120 may be provided in the form of a removable box such as a cassette. The paper mediums P may be stored in the medium storage unit 120.

A plurality of the medium storage units 120 may be removably mounted at the lower part of the case 110. The same type or different types of the paper mediums P may be stored in the respective plurality of medium storage units 120.

Referring to FIGS. 1 and 2, the medium transfer unit 130 is adapted to selectively transfer the paper mediums P stored in any one of the plurality of medium storage units 120 sheet by sheet. The medium transfer unit 130 may be disposed between the medium storage unit 120 and the rotor 160. The medium transfer unit 130 may supply the paper mediums P into the carriage 150 disposed at the rotor 160. The medium transfer unit 130 may include a plurality of rollers and belts.

Referring to FIG. 1, the medium inspection unit 140 is adapted to detect whether the paper mediums P being transferred by the medium transfer unit 130 are in a normal state, in various methods. For example, the medium inspection unit 140 may use an ultrasonic sensor or a plurality of optical sensors.

Referring to FIGS. 1 and 3, the carriage 150 is adapted to carry paper mediums P determined to be normal by the medium inspection unit 140 to the dispenser portions 111, 112, and 113. That is, the paper mediums P determined to be normal by the medium inspection unit 140 among the paper mediums P being transferred by the medium transfer unit 130 may be temporarily stacked in the carriage 150. When stacking of the paper mediums P in the carriage 150 is completed, the carriage 150 may be moved along any one of the movement paths 114, 115, and 116 and then dispense the paper mediums P through any one of the dispenser portions 111, 112, and 113. According to the present embodiment, the paper mediums P stacked in the carriage 150 are dispensed in a bundle.

The carriage 150 may include a first carriage portion 152, a second carriage portion 154, and a carriage driving portion 156.

The first carriage portion 152 may be provided in the form of a panel to tightly contact one surface of the paper medium P. When the carriage 150 is disposed inside the rotor 160, the first carriage portion 152 may be rotated along with the rotor 160 as the rotor 160 is rotated. During the operation of the medium transfer unit 130, the paper mediums P may be stacked on one surface of the first carriage portion 152. To move the stacked paper mediums P in a bundle, the first carriage portion 152 may include a first transfer belt 152*a* and a first transfer pulley 152*b* disposed at one side of the first carriage portion 152.

In addition, a guide roller 157 and a moving gear 158 may be disposed at opposite lateral sides of the first carriage portion 152, respectively. The guide roller 157 may be a roller member disposed in and moved along the guide rails 114*a*, 115*a*, and 116*a*. The moving gear 158 may be engaged with the rail gears 114*b*, 115*b*, and 116*b* and move along with the rail gears 114*b*, 115*b*, and 116*b* when rotated.

The second carriage portion 154 may be provided in the form of a panel to tightly contact the other surface of the paper mediums P. The second carriage portion 154 may be foldably connected to the carriage driving portion 156 to be in tight contact with the one surface of the first carriage portion 152. Therefore, one surface of the second carriage portion 154 may be brought into tight contact with the other surface of the paper mediums P stacked on the one surface of the first carriage portion 152. The second carriage portion 154 may include a second transfer belt 154*a* and a second transfer pulley 154*b* disposed at one side of the second carriage portion 154 to move the paper mediums P stacked on the one surface of the first carriage portion 152 in a bundle.

An opening projection 159 may be formed at one side of the second carriage portion 154. The opening projection 135 is a member to restrict rotation of the second carriage portion 154 by being interfered with the case 110 or the medium transfer unit 130 when the rotor 160 rotates. That is, when the rotor 160 rotates along with the carriage 150 in a direction toward the medium transfer unit 130, the opening projection 159 may be interfered with the case 110 or the medium transfer unit 130, thereby restricting rotation of the second carriage portion 154.

The carriage driving portion 156 may be connected with the first carriage portion 152 and the second carriage portion 154 to foldably support the first carriage portion 152 and the second carriage portion 154. That is, when a gap between the first carriage portion 152 and the second carriage portion 154 is widened, the paper mediums P transferred by the medium transfer unit 130 may be stacked on the one surface of the first carriage portion 152. Conversely, when the first carriage portion 152 and the second carriage portion 154 are folded to each other, the paper mediums P may be stably fixed in a bundle form between the one surface of the first carriage portion 152 and the one surface of the second carriage portion 154.

In addition, the carriage driving portion 156 may supply a driving force to the moving gear 158, the first transfer belt 152*a*, and the second transfer belt 154*a*. That is, the carriage driving portion 156 may include a first carriage driving portion 156*a* to drive the moving gear 158 in connection with the moving gear 158, and a second carriage driving portion 156*b* to drive the first transfer belt 152*a* and the second transfer belt 154*a* in connection with the first transfer pulley 152*b* and the second transfer pulley 154*b*. Therefore, when the first transfer belt 152*a* and the second transfer belt 154*a* are driven by the carriage driving portion 156 in a state where the first carriage portion 152 and the second carriage unit 154 are folded, the paper mediums P disposed between the first carriage portion 152 and the second carriage portion 154 may be withdrawn out of the carriage 150 by a predetermined length.

Referring to FIGS. 1 and 2, the rotor 160 may be disposed in the case 110 to be rotatable so as to convert a withdrawing direction of the carriage 150. That is, the carriage 150 may be withdrawably inserted in the rotor 160.

The rotor 160 may change a position of the carriage 150 to be directed to any one of the medium transfer unit 130, the front movement path 114, the rear movement path 115, the upper movement path 116, or a retract box 176 that will be described later. The rotor 160 may be rotated to any one of a first position, second positions, and a third position. In the first position, the paper mediums P are stacked in the carriage 150 by the medium transfer unit 130. In the second positions, the paper mediums P may be withdrawn to any one of the front movement path 114, the rear movement path 115, and the upper movement path 116. In the third position, the paper mediums P may be inserted in an entrance of the retract box 176 by the carriage 150.

Here, when the rotor 160 is in the first position, the first carriage portion 152 and the second carriage portion 154 may be separated from each other. That is, when the rotor 160 is rotated toward the first position, the opening projection 159 is interfered with the case 110 or the medium transfer unit 130, thereby restricting rotation of the second carriage portion 154. When the first rotor 160 is further rotated to the first position, the first carriage portion 152 continues rotating along with the rotor 160 while rotation of the second carriage portion 154 is restricted. Accordingly, the gap between the first carriage portion 152 and the second carriage portion 154 is widened, thereby forming a stacking space to stack the paper mediums P.

When the rotor 160 is disposed in other than the first position, the first carriage portion 152 and the second carriage portion 154 are folded to each other. That is, when the rotor 160 is rotated from the first position to other positions, the first carriage portion 152 may come into tight contact with the second carriage portion 154 and then the first carriage portion 152 and the second carriage portion 154 may be rotated in the folded state. By the first carriage portion 152 and the second carriage portion 154, the paper mediums P stacked in the stacking space S may be stably fixed.

The rotor 160 may include rotating portions 162 and a connecting portion 164. However, the rotor 160 may be configured in various forms according to the design and conditions of the ATM 100.

The rotating portions 162 may be rotatably mounted at opposite lateral sides of the case 110 and may be provided in a disc form. A carriage movement path 162*a* may be formed on an inner surface of each rotating portion 162 in the same shape as the movement paths 114, 115, and 116, to support the opposite lateral sides of the carriage 150. The guide roller 157 and the moving gear 158 formed at the opposite lateral sides of the carriage 150 may be disposed on the carriage movement path 162*a*. Also, the carriage movement path 162*a* may be opened toward an outer circumference of the rotating portion 162 so that the carriage 150 may be withdrawn out of the rotor 160. Therefore, when the rotor 160 is disposed in the second positions, the carriage movement path 162*a* is corresponded to any one of the front movement path 114, the upper movement path 116, and the rear movement path 115, thereby enabling movement of the carriage 150.

The connecting portion 164 is a plate member of which opposite sides are connected to the rotating portions 162 disposed at the opposite lateral sides of the case 110. Therefore, the rotating portions 162 disposed at the opposite lateral sides of the case 110 may be integrally rotated by the connecting portion 164. In addition, the carriage 150 disposed in the rotor 160 may be stably mounted.

Referring to FIG. 1, at least one of the rotor 160 and the carriage 150 may include a first carriage sensor 150*a* to detect whether any paper medium P is present in the carriage 150, a second carriage sensor 150*b* to detect whether the carriage 150 is disposed in a right position in the rotor 160, and a third carriage sensor 150*c* to detect whether the medium guide 180 is disposed in a right position in the carriage 150. The medium guide 180 will be described later.

Hereinafter, according to the description about the present embodiment a light emitting portion and a light receiving portion of the first carriage sensor 150*a* are disposed at the rotor 160 and the carriage 150, and the second sensor 150*b* and the third carriage sensor 150*c* are provided to the rotor 160. However, configurations and numbers of the first carriage sensor 150*a*, the second carriage sensor 150*b*, and the third carriage sensor 150*c* may be varied according to design and conditions of the ATM 100.

Referring to FIG. 1, the medium collection unit 170 is adapted to collect paper mediums P determined to be abnormal by the medium inspection unit 140, along a path bypassing the carriage 150 and the rotor 160. The medium collection unit 170 may include a reject box 172 to receive the paper mediums P determined to be abnormal by the medium inspection unit 140, and a reject transfer portion 174 including a path bypassing the rotor 160 and the carriage 150 between the reject box 172 and the medium transfer unit 130 and transferring the paper mediums P to the reject box 172.

The reject box 172 refers to a box member configured to store a plurality of the paper mediums P determined to be abnormal by the medium inspection unit 130. An entrance of the reject box 172 may be directed to the rotor 160. Additionally, rotatable roller members 172*b* may be provided at the entrance 172*a* of the reject box 172 to guide the paper mediums P into the reject box 172.

The reject transfer portion 174 guides the paper mediums P determined to be abnormal by the medium inspection unit 140 into the reject box 172 from the medium transfer unit 130. The reject transfer portion 174 may be formed as a path bypassing the rotor 160 and the movement paths 114, 115, and 116 so as not to interfere with the operation of the rotor 160 and the carriage 150.

In addition, referring to FIG. 1, the ATM 100 may further include the retract box 176 to store paper mediums P collected from the dispenser portions 111, 112, and 113 when the paper mediums P dispensed to the dispenser portions 111, 112, and 113 are not received. The retract box 176 may be disposed in the case 110 such that the entrance of the retract box 176 is directed to the rotor 160. In the present embodiment, the retracted box 176 is disposed in the reject box 172. Accordingly, space utilization of the case 110 may be further improved.

When the rotor 160 is rotated toward the entrance of the retract box 176 and disposed in the third position, the carriage 150 may be withdrawn to the entrance of the retract box 176. In addition, the paper mediums P may be inserted in the retract box 176 by the carriage 150.

The retract box 176 may be disposed in the reject box 172 to be movable or rotatable toward the entrance 172*a* of the reject box 172. That is, when the paper mediums P in a bundle not received by the dispenser portions 111, 112, and 113 are put in the entrance 172*a* of the reject box 172, the entrance 176*a* of the retract box 176 may be moved or rotated to the entrance 172*a* of the reject box 172. Therefore, the paper mediums P introduced through the entrance 172*a* of the reject box 172 may be stacked in the retract box 176. In the present embodiment, a lower part of the retract box 176 will be described to be rotatably hinged to a lower part of the reject box 172 and to be rotated about a hinge shaft by a separate driving portion (not shown).

Referring to FIG. 1, the ATM 100 may further include a main driving portion 117 disposed in the case 110 to provide a driving force to the medium transfer unit 130 and the medium collection unit 170. That is, the medium transfer unit 130, the reject transfer portion 174, and the reject roller 172*b* of the reject roller 172 may be driven together by the driving force of the main driving portion 117. Meanwhile, the rotor 160 may be controlled independently by a separate driving portion 166.

Referring to FIGS. 1, 3, and 7, the ATM 10 according to the embodiment of the present invention may further include a medium guide 180 and a guide adjustment device 190.

The medium guide 180 is adapted to adjust size of the stacking space S according to size of the paper mediums P stacked in the stacking space of the carriage 150. The medium guide 180 may be movable in the transfer direction of the paper mediums P being put into the stacking space S of the carriage 150. Accordingly, the paper mediums P transferred to the stacking space S of the carriage 150 by the medium transfer unit 130 may be interfered with the medium guide 180 with one end and therefore stably stacked in a proper position in the stacking space S.

Referring to FIGS. 3 to 5, the medium guide 180 may include a movable plate 182 disposed at a lower part of the first carriage portion 152 to be movable in a width direction of the paper mediums P, a plurality of medium guiding projections 184 protruding from the movable plate 180 to guide a stacking position of the paper mediums P being transferred to the stacking space S, and an elastic member (not shown) connected to the carriage 150 and the movable plate 182 to provide an elastic force to the movable plate 182 in a first direction S1 increasing the stacking space S.

The movable plate 182 may be disposed at the lower part of the first carriage portion 152 to be slid in the width direction of the paper mediums P. Hereinafter, the width direction of the paper mediums P will be described to be the same as the transfer direction of the paper mediums P. A locking portion 182*a* may be protruded downward at a lower part of the movable plate 182.

The medium guiding projections 184 may protrude upward from an upper part of the movable plate 182, being distanced from each other in lateral directions. The first carriage portion 152 and the second carriage portion 154 may include slit holes 151 and 153 disposed for the medium guiding projections 184 to pass through.

On a front surface of each of the medium guiding projections 184, a damping portion 184*a* may be provided to absorb a collision impact with the paper mediums P being transferred to the stacking space S. The damping portion 184*a* may be disposed at the front surface of each of the medium guiding projections 184 and elastically pushed in the first direction S1. Therefore, although the paper mediums P transferred by the medium transfer unit 130 at a predetermined speed collides with the front surface of each of the medium guiding projection 184, the paper mediums P may not be bounced out nor folded or creased by the collision impact.

Referring to FIGS. 6 and 7, the guide adjustment device 190 may adjust the size of the stacking space S by moving the medium guide 180 according to the width of the paper mediums P being transferred to the stacking space S of the carriage 150. The guide adjustment device 190 may be provided at the rotor 160 so as to be connected with the medium guide 180 of the carriage 150 received in the rotor 160. That is, since the guide adjustment device 190 adjusts the position of the medium guide 180 according to the size of the paper mediums P, various sizes of the paper mediums P transferred by the medium transfer unit 130 may be smoothly stacked in the stacking space S.

The guide adjustment device 190 may include a stopper 191 provided to the rotor 160 to be linearly moved, and adapted to move the movable plate 182 in a second direction S2 decreasing the stacking space S when interfered with the locking portion 182*a*, a stopper driving portion 192 provided at the rotor 160 to supply a driving force to the stopper 191, and a power transmission member 193 disposed between the stopper driving portion 192 and the stopper 191 to transmit the driving force of the stopper driving portion 192. That is, the driving force generated by the stopper driving portion 192 may be transmitted to the stopper 191 through the power transmission member 193. By a moving force of the stopper 191, the movable plate 182 may be moved in the second direction S2.

The stopper 191 may be provided at the connecting portion 164 to be movable in the transfer direction of the paper mediums P. A locking projection 191*a* may be formed at an upper part of the stopper 191 to be engaged with the locking portion 182*a* of the movable plate 182.

The stopper driving portion 192 may be mounted to an outer side surface of the rotating portion 162 of the rotor 160. The stopper driving portion 192 may include a motor. By adjusting a rotation degree of the stopper driving portion 192, the position of the movable plate 182 may be controlled by the stopper 191.

The power transmission member 193 may include a power transmission shaft 194 rotatably mounted to the rotor 160, a gear portion 195 to transmit the driving force to an end of the power transmission shaft 194, and a link portion 196 connected to the other end of the power transmission shaft 194 and the stopper 191 to convert a rotational force of the power transmission shaft 194 to a linear motion force of the stopper 191.

The end of the power transmission shaft 194 may be disposed at the rotating portion 162 to which the stopper driving portion 192 is mounted. The other end of the power transmission shaft 194 may be disposed at the connecting portion 164 of at which the stopper 191 is disposed.

The gear portion 195 may include a driving gear 195*a* connected to the rotational axis of the stopper driving portion 192, a driven gear 195*b* connected to the end of the power transmission shaft 194, and at least one relay gear 195*c* rotatably provided to the rotating portion 162 and disposed between the driving gear 195*a* and the driven gear 195*b* to be operated in association with the driving gear 195*a* and the driven gear 195*b*. That is, when at least one relay gear 195*c* is properly combined with the driving gear 195*a* and the driven gear 195*b*, a magnitude and a direction of the driving force transmitted to the power transmission shaft 194 may be converted conveniently. Hereinafter, the present embodiment will be described to include a single relay gear 195*c* disposed between the driving gear 195*a* and the driven gear 195*b*.

Any one of the driving gear 195*a*, the driven gear 195*b*, and the relay gear 195*c* may include a position setting rib 197 formed in an arc shape along a circumference of the gear. The third carriage sensor 150*c* may detect the position setting rib 197, thereby extracting a right position of the medium guide 180. Therefore, whether the medium guide 180 is disposed in the right position may be correctly detected using the position setting rib 197 and the third carriage sensor 150*c*. Accordingly, the right position of the medium guide 180 may be variably set by changing a shape of the position setting rib 197 and a position of the third carriage sensor 150*c*.

Figure 8:
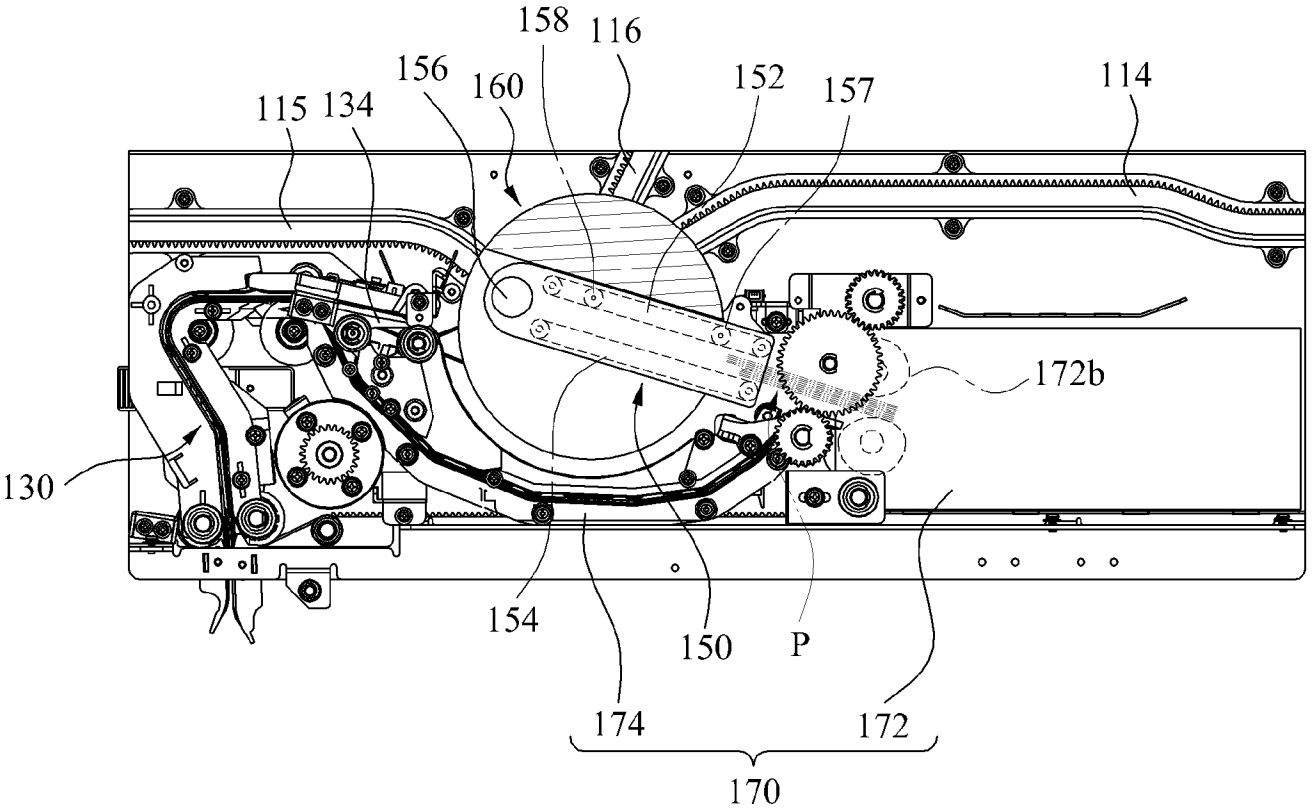
FIG. 8 is an operational state view illustrating an operation of collecting paper mediums to a retract box in an ATM according to an embodiment of the present invention.
Figure 9:
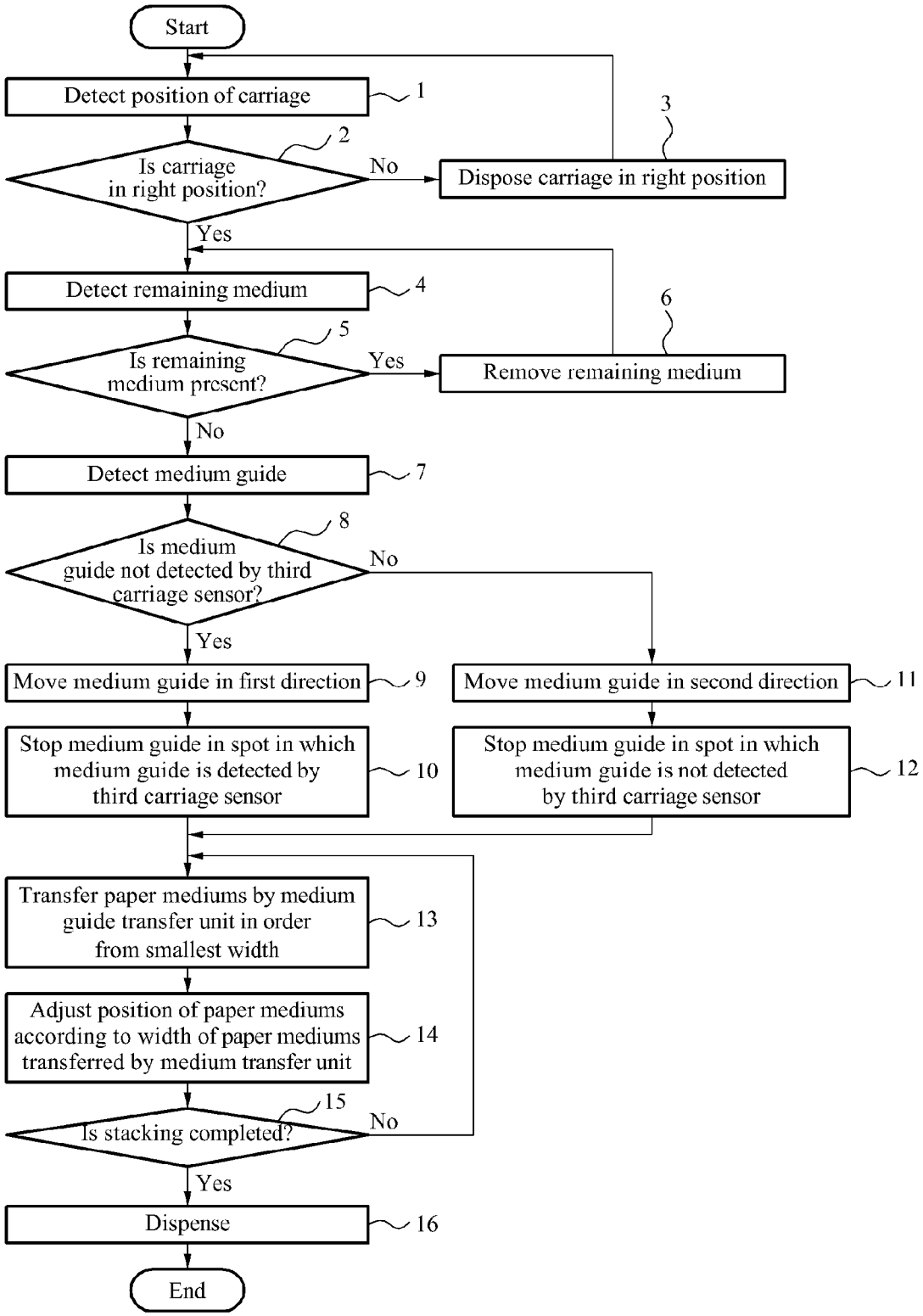
FIG. 9 is a flow chart illustrating a control method for an ATM according to an embodiment of the present invention.

Hereinafter, the operational process of the above-structured ATM 100 will be described. FIG. 8 is an operational state view illustrating an operation of collecting paper mediums to a retract box in an ATM according to an embodiment of the present invention. FIG. 9 is a flow chart illustrating a control method for an ATM according to an embodiment of the present invention.

Referring to FIG. 9, the control method for the ATM 100 may include carriage positioning 1 to 3, remaining medium removing 4 to 6, guide positioning 7 to 12, stacking space adjusting 13 and 14, and medium stacking 15.

In the carriage positioning 1 to 3, the second carriage sensor 150*b* may detect whether the carriage 150 is disposed in the right position in the rotor 160. When the carriage 150 is detected to be not in the right position, the carriage 150 may be driven to be disposed in the right position in the rotor 160. That is, the carriage 150 may be moved to a position to be detected by the second carriage sensor 150*b*.

In the remaining medium removing 4 to 6, the first carriage sensor 150*a* may detect whether any paper medium P remains in the stacking space S of the carriage 150. When the paper medium P remaining in the stacking space S is detected, the paper medium P may be removed. That is, a message for removing the paper medium P remaining in the stacking space S may be output to the outside so that the paper medium P is manually removed. Alternatively, the carriage 150 and the rotor 160 may be operated to collect the paper medium P into the reject box 172 as shown in FIG. 8.

In the guide positioning 7 to 12, the third carriage sensor 150*c* may detect whether the medium guide 180 is disposed in the right position in the carriage 150. When the medium guide 180 is detected to be not in the right position, the guide adjustment device 190 may be driven to move the medium guide 180 to the right position.

More specifically, the guide positioning 7 to 12 may include determining 7 to 8 to determine whether the medium guide 180 is detected by the third carriage sensor 150*c*, positioning 9 to 10 to move the medium guide 180 by the guide adjustment device 190 in the first direction S1 to dispose the medium guide 180 in a spot detected by the third carriage sensor 150*c* when the medium guide 180 is not detected by the third carriage sensor 150*c*, and positioning 11 to 12 to move the medium guide 180 by the guide adjustment device 190 in the second direction S2 to dispose the medium guide 180 in a spot not detected by the third carriage sensor 150*c* when the medium guide 180 is detected by the third carriage sensor 150*c*. That is, the right position of the medium guide 180 may be set to a boundary between positions in which the medium guide 180 is detected or not detected by the third carriage sensor 150*c*.

In the stacking space adjusting 13 to 14, the guide adjustment device 190 may adjust the size of the stacking space S by moving the medium guide 180 according to the width of the paper mediums P to be stacked in the stacking space S. That is, in the stacking space adjusting 13 to 14, when the paper mediums P to be stacked in the stacking space S are in various widths, the stacking space S may be adjusted to gradually increase in the first direction S. Therefore, the medium transfer unit 130 may transfer the paper mediums P to the carriage 150 in order of smaller width.

This is because, when paper mediums P of larger widths are stacked first, the position of the medium guide 180 cannot be adjusted in the second direction. Therefore, paper mediums P of smaller widths may be stacked in the stacking space S of the carriage 150 for the medium guide 180 to cope with all kinds of the paper mediums P transferred to the stacking space S.

In the medium stacking 15, the medium transfer unit 130 may stack the paper mediums P in the stacking space S of which size is adjusted by the guide adjustment device 190. Here, in the medium stacking 15, the paper mediums P may be supplied to the stacking space S by the medium transfer unit 130 in order from smallest width to largest width.

When the paper mediums P are stacked in the carriage 150 in the medium stacking 15, the carriage 150 and the rotor 160 are driven to dispense the paper mediums P to any one of the dispenser portions 111, 112, and 113.

For example, the rotor 160 is rotated from the first position to the second positions, and the first carriage portion 152 rotated along with the rotor 160 is folded to the second carriage portion 154. Accordingly, the first carriage portion 152 and the second carriage portion 154 may stably fix the paper mediums P stacked in the stacking space S. Next, the rotor 160 may be rotated to any one of the second positions to dispense the paper mediums P, according to positions of the dispenser portions 111, 112, and 113.

That is, when the rotor 160 is rotated to a position fluidly communicating with any one of the movement paths 114, 115, and 116, the carriage 150 in the rotor 160 may be moved to the dispenser portions 111, 112, and 113 along the carriage movement path 162*a* and any one of the movement paths 114, 115, and 116. The first transfer belt 152*a* and the second transfer belt 154*a* of the carriage 150 moved to the dispenser portions 111, 112, and 113 may be operated. Accordingly, the paper mediums P may be withdrawn out of the case 110 through the front dispenser portion 111.

Although a few embodiments of the present invention have been shown and described, the present invention is not limited to the described embodiments. Instead, it would be appreciated by those skilled in the art that changes may be made to these embodiments without departing from the principles and spirit of the invention, the scope of which is defined by the claims and their equivalents.

The invention claimed is:

1. An automatic teller machine (ATM) comprising:

a case in which a dispenser portion is disposed in different positions;

a medium transfer unit provided in the case to transfer paper mediums to be dispensed through the dispenser portion;

a carriage including a stacking space to temporarily stack the paper mediums, being configured to be moved to the dispenser portion along a movement path formed in the case;

a rotor in which the carriage is withdrawably inserted, being configured to be rotated along with the carriage between a first position in which the paper mediums are stacked in the carriage and a second position in which the carriage is moved to the movement path;

a medium guide movably provided to the carriage to adjust size of the stacking space according to size of the paper mediums being transferred to the stacking space; and a guide adjustment device provided to the rotor and configured to be connected to the medium guide when the carriage is received in the rotor to adjust a position of the medium guide.

2. The ATM of claim 1, wherein at least one of the rotor and the carriage comprises:

a first carriage sensor to detect whether a paper medium is present in the carriage;

a second carriage sensor to detect whether the carriage is disposed in a right position in the rotor; and a third carriage sensor to detect whether the medium guide is disposed in a right position in the carriage.

3. The ATM of claim 1, wherein the medium guide comprises:

a movable plate disposed at a lower part of the carriage to be movable in a width direction of the paper mediums;

a medium guiding projection protruding from the movable plate to guide a stacking position of the paper mediums being transferred to the stacking space; and an elastic member connected to the carriage and the movable plate to provide an elastic force to the movable plate in any one direction between a first direction increasing the stacking space and a second direction decreasing the stacking space.

4. The ATM of claim 3, wherein the medium guiding projection comprises a damping portion disposed on a front side to absorb a collision impact with the paper mediums being transferred to the stacking space.

5. The ATM of claim 3, wherein the carriage comprises a first carriage portion rotated along with the rotor when the rotor rotates, a second carriage portion disposed to face the first carriage portion so that the stacking space is formed between the first carriage portion and the second carriage portion, and a carriage driving portion connected to the first carriage portion and the second carriage portion so that the first carriage portion and the second carriage portion are folded to each other and moved along the movement path, and the movable plate is provided to the first carriage portion while the medium guiding projections are disposed to pass through a slit hole formed at the second carriage portion.

6. The ATM of claim 1, wherein the medium adjustment device comprises:

a stopper connected to a locking portion formed at the medium guide when the carriage is disposed in the rotor, being provided to the rotor to linearly move to move the medium guide in another direction between a first direction increasing the stacking space and a second direction decreasing the stacking space;

a stopper driving portion provided at the rotor to supply a driving force to the stopper; and a power transmission member disposed between the stopper driving portion and the stopper to transmit the driving force of the stopper driving portion.

7. The ATM of claim 6, wherein the power transmission member comprises:

a power transmission shaft rotatably provided to the rotor;

a gear portion provided to an end of the power transmission shaft to transmit the driving force of the stopper driving portion; and a link portion connected to the other end of the power transmission shaft and the stopper to receive a rotational force of the power transmission shaft and convert the rotational force to a linear motion force of the stopper.

8. The ATM of claim 7, wherein the gear portion comprises:

a driving gear connected to the stopper driving portion;

a driven gear connected to the end of the power transmission shaft; and at least one relay gear rotatably provided to the rotor and disposed between the driving gear and the driven gear to be operated in association with the driving gear and the driven gear.

9. The ATM of claim 7, wherein the gear portion comprises a position setting rib provided around the gear portion in an arc shape, at least one of the rotor and the carriage comprises a carriage sensor to detect whether the medium guide is disposed in a right position in the carriage, and the carriage sensor detects the position setting rib to detect whether the medium guide is in the right position.

10. The ATM of claim 9, wherein the rotor comprises rotating portions disposed at opposite side surfaces of the case to be rotatable to movably support opposite sides of the carriage, and a connecting portion connected to the rotating portions disposed at the opposite side surfaces of the case with opposite sides and configured to receive the carriage, and the stopper, the power transmission shaft, and the link portion are connected to the connecting portion whereas the stopper driving portion, the gear portion, and the carriage sensor are provided at an outer side surface of the rotating portion.

11. A control method for an automatic teller machine (ATM) of claim 1, the control method comprising:

carriage positioning to detect whether the carriage is disposed in the right position in the rotor and drive the carriage so that the carriage is disposed in the right position in the rotor when the carriage is detected to be not in the right position;

remaining medium removing to detect presence of a remaining paper medium in the stacking space of the carriage and remove the remaining paper medium when the remaining paper medium in the stacking space is detected;

guide positioning to detect whether the medium guide is disposed in the right position of the carriage and to move the medium guide to the right position of the carriage by the guide adjustment device when the medium guide is detected to be not in the right position;

stacking space adjusting to adjust the size of the stacking space by moving the medium guide by the guide adjustment device according to a width of the paper mediums to be stacked in the stacking space; and medium stacking to stack the paper mediums by the medium transfer unit in the stacking space which is size-adjusted by the guide adjustment device.

12. The control method of claim 11, wherein at least one of the rotor and the carriage comprises a third carriage sensor to detect whether the medium guide is disposed in a right position in the carriage, and the guide positioning comprises:

determining whether the medium guide is detected by the third carriage sensor;

positioning the medium guide in a spot detected by the third carriage sensor when the medium guide is not detected, by moving the medium guide by the guide adjustment device in any one direction between the first direction increasing the stacking space and the second direction decreasing the stacking space; and positioning the medium guide in a spot not detected by the third carriage sensor when the medium guide is detected, by moving the medium guide by the guide adjustment device in any one direction between the first direction increasing the stacking space and the second direction decreasing the stacking space.

13. The control method of claim 11, wherein the stacking space adjusting comprises adjusting the stacking space when the paper mediums to be stacked in the stacking space have various width in the first direction increasing the stacking space, and the medium stacking comprises stacking the paper mediums in the stacking space by the medium transfer unit in order from smallest width to largest width.

* * * * *